US006241204B1

(12) United States Patent
Bermes

(10) Patent No.: US 6,241,204 B1
(45) Date of Patent: Jun. 5, 2001

(54) PAINT BUCKET HOLDER FOR HOLLOW RUNG LADDERS

(76) Inventor: Michael L. Bermes, 115 Dora Dr., Brownsboro, AL (US) 35741

( * ) Notice: Subject to any disclaimer, the term of this patent is extended or adjusted under 35 U.S.C. 154(b) by 0 days.

(21) Appl. No.: 09/547,680

(22) Filed: Apr. 12, 2000

(51) Int. Cl.[7] ..... E06C 7/14
(52) U.S. Cl. ..... 248/210; 182/129
(58) Field of Search ..... 248/210, 211, 248/238; 182/129

(56) References Cited

U.S. PATENT DOCUMENTS

| | | | | |
|---|---|---|---|---|
| 3,857,537 | * | 12/1974 | Swalinkavich, Jr. | 248/210 |
| 4,523,733 | | 6/1985 | Lunder, Jr. | 248/210 |
| 4,702,446 | | 10/1987 | Brown | 248/210 |
| 4,824,060 | | 4/1989 | Korda | 248/210 |
| 5,259,525 | * | 11/1993 | Wion | 248/210 X |
| 5,293,957 | * | 3/1994 | Lunden, Jr. | 182/129 |
| 5,316,251 | | 5/1994 | McGraw | 248/210 |
| 5,649,682 | | 7/1997 | Martin | 248/210 |
| 5,845,742 | | 12/1998 | Tade | 182/129 |
| 5,934,632 | | 8/1999 | Weaver | 248/210 |

* cited by examiner

*Primary Examiner*—Ramon O. Ramirez
(74) *Attorney, Agent, or Firm*—Joseph H. Beumer

(57) ABSTRACT

A paint bucket holder that holds a paint bucket firmly and securely is safely, securely, and removably attached to a hollow rung ladder. A paint bucket container, including a base, upright panel, and side braces, provides a seat and perpendicular support for the paint bucket. An elastic cincture encircles the paint bucket and secures it firmly against the upright panel. An arm support sleeve is rigidly attached to the front top edge of the upright panel, slightly above the lip of the paint bucket, restricting upward movement of the paint bucket, and containing and securing a rung attachment arm. The rung attachment arm is inserted into the selected ladder hollow rung recess, supporting the paint bucket holder, containing the paint bucket. The rung attachment arm is selectively positioned to either side of the paint bucket holder by sliding the arm within the arm support sleeve and is secured in place by an arm detent. A stabilization projection, rigidly attached on the bottom, at the front edge, of the container base, contacts the upper edge of the ladder leg and has a perpendicular flange at each end which prevents inadvertent extraction of the arm from the ladder rung. A vertical arm holder is rigidly attached to the backside of the upright panel, providing a stowage location for the rung attachment arm while in transit, from site to site, or for storage of the paint bucket container.

19 Claims, 12 Drawing Sheets

PAINT BUCKET HOLDER FOR HOLLOW RUNG LADDERS

CROSS-REFERENCE TO RELATED APPLICATIONS

Not applicable

BACKGROUND—Field of Invention

This invention relates to securely attaching a paint bucket to a hollow rung extension ladder so that the contents are conveniently available to a user and so that the paint bucket can be easily removed and relocated without adversely impacting the user's activities.

BACKGROUND—Description of Prior Art

As a part-time painter, the inventor recognized the need to safely and securely attach a paint bucket to an extension ladder in a conveniently accessible location such that his hands would be free to grip the ladder and maneuver the paint brush while working on the ladder. He fabricated a crude first model of his invention from plywood and other left over wooden items and found that his concept generally satisfied his need. He developed the improvements to this original model to provide capability for easily moving the apparatus from one side of the ladder to the other while he was standing on the ladder. A prototype, including the improvements, has been built and tested by the inventor to validate the claims of this invention.

The inventor originally made an effort to find a commercially available paint bucket holder to answer his need, with no success. Although there have been an abundance of patents issued pertaining to the paint bucket or can holder art, there appears to have been very little commercial success in the field. The inventor intends to fill this void with the product of his invention. In addition to testing the invention prototype under "field" conditions, all aspects of advertising, manufacturing, and distributing the invention are being analyzed in detail. The internet offers a new and innovative way to bring this product to the attention of potential users and is being considered as part of the marketing strategy.

Nearly 100 patents were researched via the US Patent and Trademark Office Database on the internet from the field of paint container holders. Most of the patents researched were from a non-analogous art. Some involved a paint bucket holder that attached to the user's silhouette, others mounted on a step ladder, others either clamped to the edge of an extension ladder or were hung from a ladder rung. The eight patents listed herein were found to apply to the art of a paint bucket holder using a ladder hollow rung for attachment. All eight of these inventions have disadvantages that the present invention overcomes. There is a basic over-all security issue with all eight inventions, due generally to the approach to attachment of the paint can to the ladder hollow rung. The paint bucket has the capability to essentially swing or rotate about the horizontally disposed axis established by the support arm inserted in the hollow rung. This is generally done to maintain the paint bucket in a level, upright orientation. The disadvantage of this approach is that it creates a perception of insecurity on the part of the user due to movement of the paint bucket while paint is being extracted with a brush, especially as the level of the paint in the bucket decreases. The degree of risk of this movement during usage is invention specific, dependent upon the support arm cross section design.

| U.S. Pat. No. | Inventor | Issue Date |
|---|---|---|
| 5,934,632 | Norman W. Weaver | 08/10/99 |
| 5,845,742 | Erin Jessica & Robert Thomas Tade | 12/08/98 |
| 5,649,682 | Julius F. Martin | 07/22/97 |
| 5,316,251 | Raymond V. McGraw | 05/31/94 |
| 4,824,060 | Edward S. Korda | 04/25/89 |
| 4,702,446 | Franklin C. Brown | 10/27/87 |
| 4,523,733 | Charles K. Lunder, Jr. | 06/18/85 |
| 4,099,693 | Ellis L. Blann | 07/11/78 |

U.S. Pat. No. 5,934,632 by Weaver describes a utility can holder for use with hollow rung ladders. The paint can or bucket rests with the bail connecting knobs, or alternately, the bucket lip, contacting the upper surface of an annular support member. This support member is rigidly attached to a rung insert member which extends completely through the ladder hollow rung from one side to the other. Flexible tabs are compressed prior to insertion of this member into the rung and then open on the other side of the ladder to prevent inadvertent extraction from within the rung. The annular support member is rotatable within the rung to allow leveling of the paint bucket. This rotatability may cause instability as the user extracts paint from the bucket, as discussed in the preceding paragraph. It is also evident that the positioning and attachment of the paint bucket on the ladder is a two step procedure. The rung insert member must be secured within the selected ladder hollow rung prior to inserting the paint bucket into the container recess. The insertion of the rung insert member into the hollow rung is a "two hand operation", involving holding the approximately 30 inch long holder with one hand and depressing the flexible tabs with the other hand. Only after the rung insert member is in place can the user climb off the ladder and transport the paint bucket back up the ladder to insert it into the container recess. Thus, significant complication is involved with moving the paint can holder from position to position on the ladder.

U.S. Pat. No. 5,845,742 by Tade describes a paint can or bucket hanging by its bail from a T-shaped support member which is attached to one end of an extension member. The rod-like extension member is inserted into a ladder hollow rung. The paint bucket is supported by its bail which is vertically disposed directly above the lip of the paint bucket. This positioning of the bail interferes with extraction of the paint from the bucket with a paint brush.

U.S. Pat. No. 5,649,682 by Martin supports a container within an encircling cincture formed from a flattened projecting arm that is inserted into a ladder hollow rung. The support part of the projection arm that is inserted into the ladder hollow rung is relatively short and is not attached securely within the hollow rung. There is, at least, the perception of this device being a security risk due to the real possibility that the arm may be inadvertently extracted from the rung opening during usage.

U.S. Pat No. 5,316,251 by McGraw is directed at leveling a paint can in two dimensions. The paint can rests upon a wrap around frame that is elliptical shaped and may be either closed or open at one end. This frame is rigidly attached to a cylindrical handle that is inserted into a ladder hollow rung to support the frame and the paint can. The disadvantage of this approach is that the paint bucket may be dislodged from its position atop the frame and, at least, spill some or all of its contents, or at worst, be a safety hazard to persons on the ground. As with the invention by Martin, the cylindrical handle is relatively short compared to the length of the ladder rung and is not secured within the ladder rung. In addition, in one embodiment of the invention, the paint can is not enclosed on one side by the wrap-around frame, increasing the risk of dislodgment. Both of these conditions contribute to the perception of insecurity by the user.

U.S. Pat. No. 4,824,060 by Korda provides a holder for supporting a paint bucket or can that is basically a cradle in which the paint can rests on a plate and is contained within a cylindrical member slightly larger in diameter than the outside of the paint can. A detachable rod is inserted through the ladder rung such that a swing plate latch falls vertically and secures the rod from extraction from the rung. The "cradle", containing the paint bucket is attached to the other end of the rod. Korda's approach provides a higher degree of security than is available for the inventions previously discussed. However, the procedure for mounting the paint bucket onto the ladder is fairly complicated, not providing for ease of movement to another rung on the ladder by the user. The rod is mounted at the desired position on the ladder before the holder is attached to the end of the rod, followed by insertion of the paint bucket into the holder cradle. This procedure appears to involve at least two, and maybe more, trips up the ladder, and is not compatible with easily and conveniently changing the position of the paint can while the user is working on the ladder.

U.S. Pat. No. 4,702,446 by Brown provides a holder very similar, though not quite as secure as Korda, which is also attached to a holding arm which is inserted into a ladder hollow rung. As discussed previously for the invention by Martin, the holding arm is relatively short, and although Brown has provided soft rubber friction sleeves at both ends of the arm to restrict slippage, there is still risk that the arm could be inadvertently extracted from the rung opening during usage. The interior of the ladder hollow rung is not circular and will not make continuous, firm contact with the circular shaped friction sleeves. Further, the friction sleeves may make minimal contact with the rung interior for a specific application since the cross section shape and size of the hollow rung interior varies significantly for ladders manufactured over the last two decades.

U.S. Pat. No. 4,523,733 by Lunden contains the paint container on a seat, enclosed on all four sides by vertical flanges, bent perpendicular to the seat. A rod is inserted entirely through holes in, and is rigidly attached to, two triangular shaped flanges at opposite ends of, and perpendicular to, the seat. This rod is inserted into a ladder hollow rung to support the paint container. The paint container may rotate with the rod, about the horizontal axis of the rod, creating a perception of insecurity. The rod extends across the center of the mouth of the paint container and interferes with extraction of paint using a brush. Also, as with the Martin and Brown inventions, the end of the rod that is inserted into the hollow rung is relatively short and is susceptible to being inadvertently dislodged from within the hollow rung.

U.S. Pat. No. 4,099,693 by Blann supports a paint bucket by hooking the bail of the bucket over a short upturned projection on an elongated member that engages the hollow rung. A short downward projecting bracket holds the vertical, cylindrical edge of the bucket. The elongated member is essentially a rod with an upward bend on the end that extends through the hollow rung. This bend hooks the outer surface of the ladder leg to prevent extraction from the rung. As with the invention by McGraw, there is a perception of a substantial security risk with the use of this device. The paint bucket could be accidentally dislodged, particularly when the paint level in the bucket is low so that the pressure holding the bucket against the container side support bracket is reduced. Additionally, the diameter of the rod, engaging the ladder rung, is small compared to the rung interior dimensions and could cause the bucket to wobble as paint is removed.

SUMMARY

The present invention is for a paint bucket holder to safely and securely contain a paint bucket while attached easily, conveniently, securely, and removably to a hollow rung ladder. The paint bucket holder and paint bucket act as a single unit which is transportable and attachable, with one hand, to a selected hollow rung on a typical extension ladder. When attached to the ladder, the unit is not susceptible to being inadvertently dislodged and provides convenient access to the paint in the bucket with no interference. Positioning and orientation of the paint bucket holder on the ladder is such as to minimize contact with any structure supporting the ladder and to maintain the paint bucket in a near upright disposition over typical, safe ladder inclinations.

Objects and Advantages

Several objects and advantages of the present invention include:

a) A paint bucket is easily and firmly secured within the paint bucket holder.

b) The paint bucket can not be inadvertently dislodged from the paint bucket holder.

c) The paint bucket and bucket holder are transported, as a single unit, with one hand.

d) The paint bucket and bucket holder unit is securely, safely, and removably attached to a hollow rung ladder.

e) The paint bucket contents are conveniently located for use by the painter.

f) The paint bucket is maintained in a near upright disposition over a range of typical and safe extension ladder inclinations.

g) The paint bucket holder does not interfere with extraction of paint from the paint bucket.

h) The paint bucket holder is positioned and secured on the ladder to minimize interference by contact of any structure supporting the ladder.

i) The paint bucket holder is easily removed and relocated to an alternate position on the ladder by the user while standing on the ladder.

j) The overall profile of the paint bucket holder is conveniently minimized for transport or storage.

k) The paint bucket holder is readily and economically manufactured from commercially available materials.

Further objects and advantages of the invention will become apparent from a consideration of the drawings and ensuing description.

DRAWING FIGURES

In the drawings, several views illustrate the elements and parts, assemblage, and envisioned usage of representative embodiments of the invention, in which like reference numbers refer to like elements or parts and wherein.

FIG. 8 through FIG. 11 are a series of front views of the paint bucket holder, containing and supporting the paint bucket, being held by a user, showing the user's hands to illustrate the steps in sliding the rung attachment arm to extend on the opposite side of the paint bucket holder, with the exterior of the rung at arm and an arm support sleeve in cross section to expose a contained arm dentent (eg. butterfly clip).

Figure 12C:
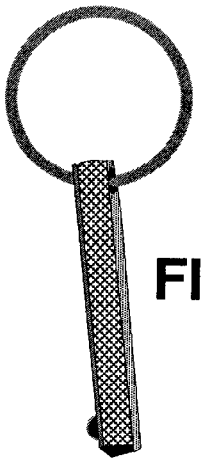
Figure 12B:
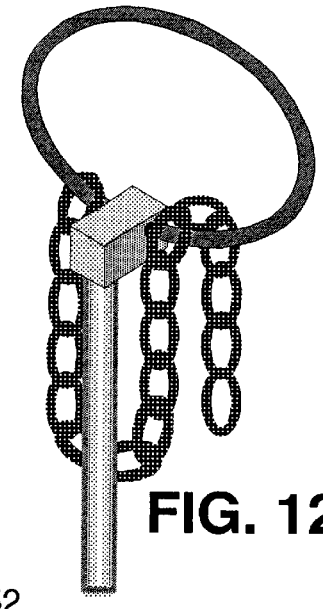
Figure 12A:
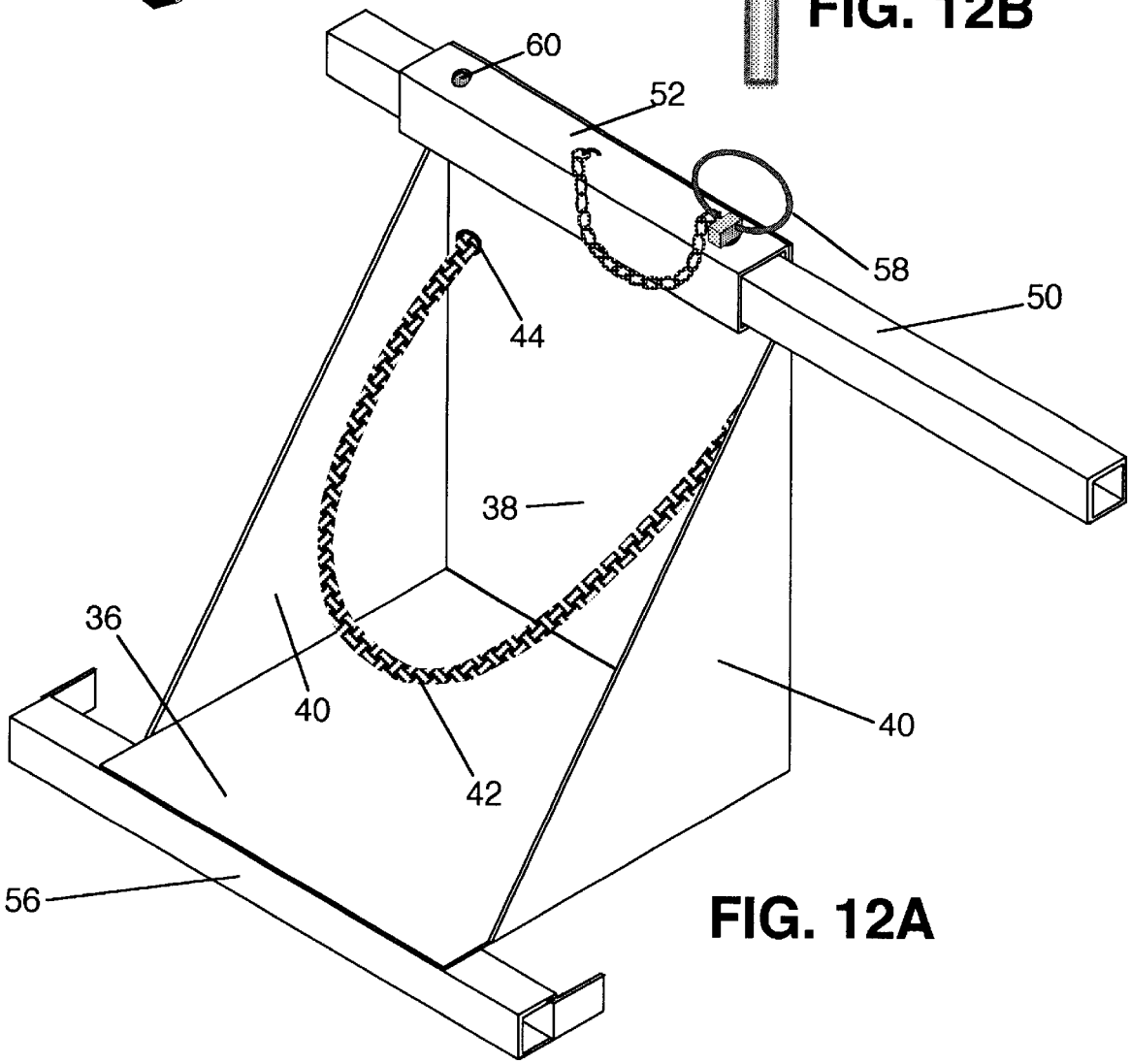

FIG. 12A a perspective view of the paint bucket holder illustrating an alternative arm detent configuration.

FIG. 12B a full scale perspective drawing of the arm detent element that is configured into the paint bucket holder in FIG. 12A.

FIG. 12C is a full scale perspective drawing of an additional alternative for the arm detent element of the present invention.

REFERENCE NUMERALS IN DRAWINGS

| | |
|---|---|
| 20 | hollow rung ladder |
| 22 | ladder leg |
| 24 | ladder hollow rung |
| 26 | hollow rung cavity |
| 28 | paint bucket |
| 30 | paint bucket bail |
| 32 | paint bucket holder |
| 34 | paint bucket container |
| 36 | container base |
| 38 | upright panel |
| 40 | triangular brace |
| 42 | elastic cincture |
| 44 | cincture aperture |
| 46 | cincture knot |
| 48 | ladder attachment apparatus |
| 50 | rung attachment arm |
| 52 | arm support sleeve |
| 54 | arm holder |
| 56 | stabilization projection |
| 58 | arm detent |
| 60 | arm detent orifice |

Description—Preferred Embodiment

Figure 1:
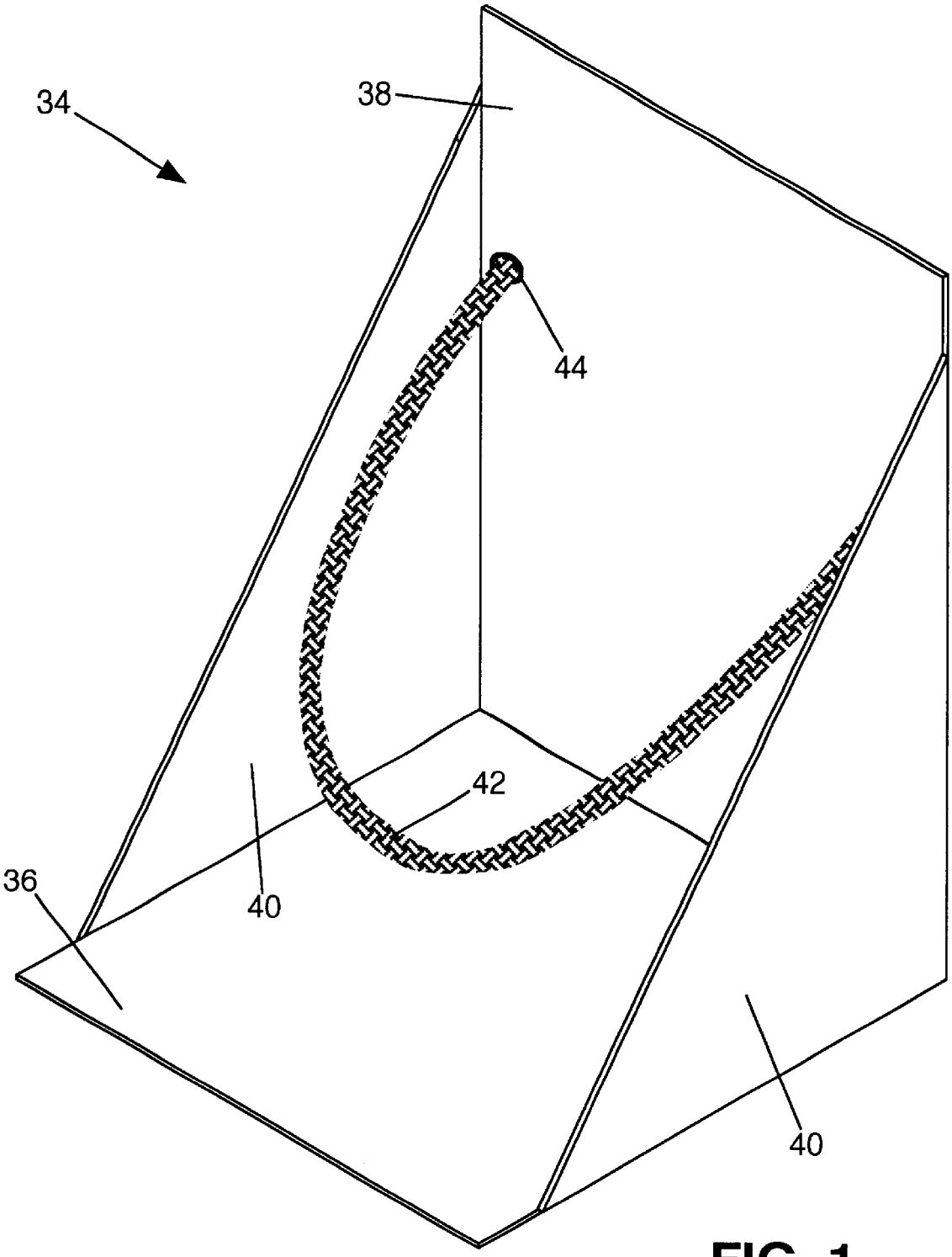
FIG. 1 is a perspective view of an assembled paint bucket container element of a paint bucket holder.
Figure 2:
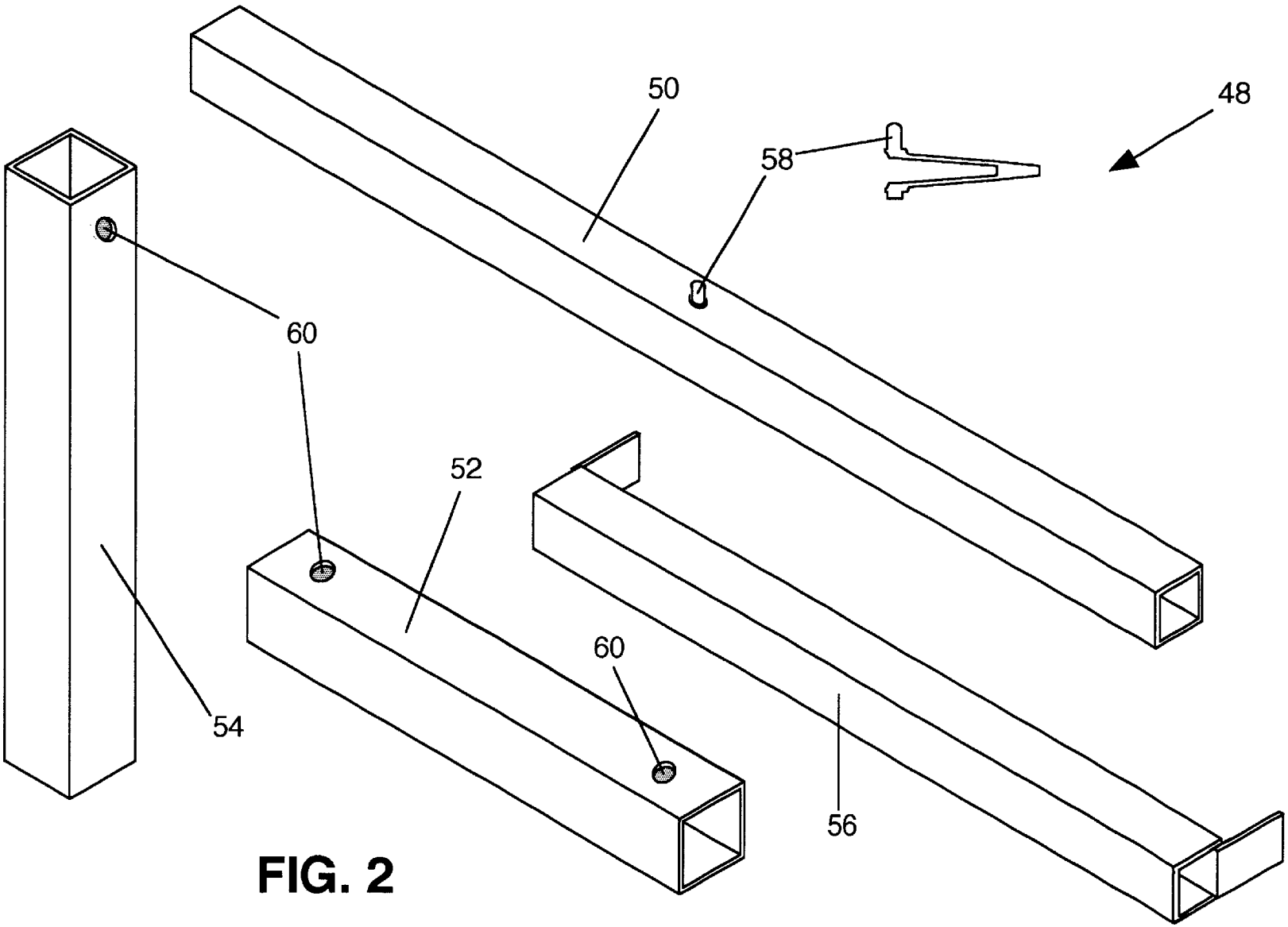
FIG. 2 is a perspective view of individual parts of a ladder attachment apparatus element of the paint bucket holder.
Figure 5:
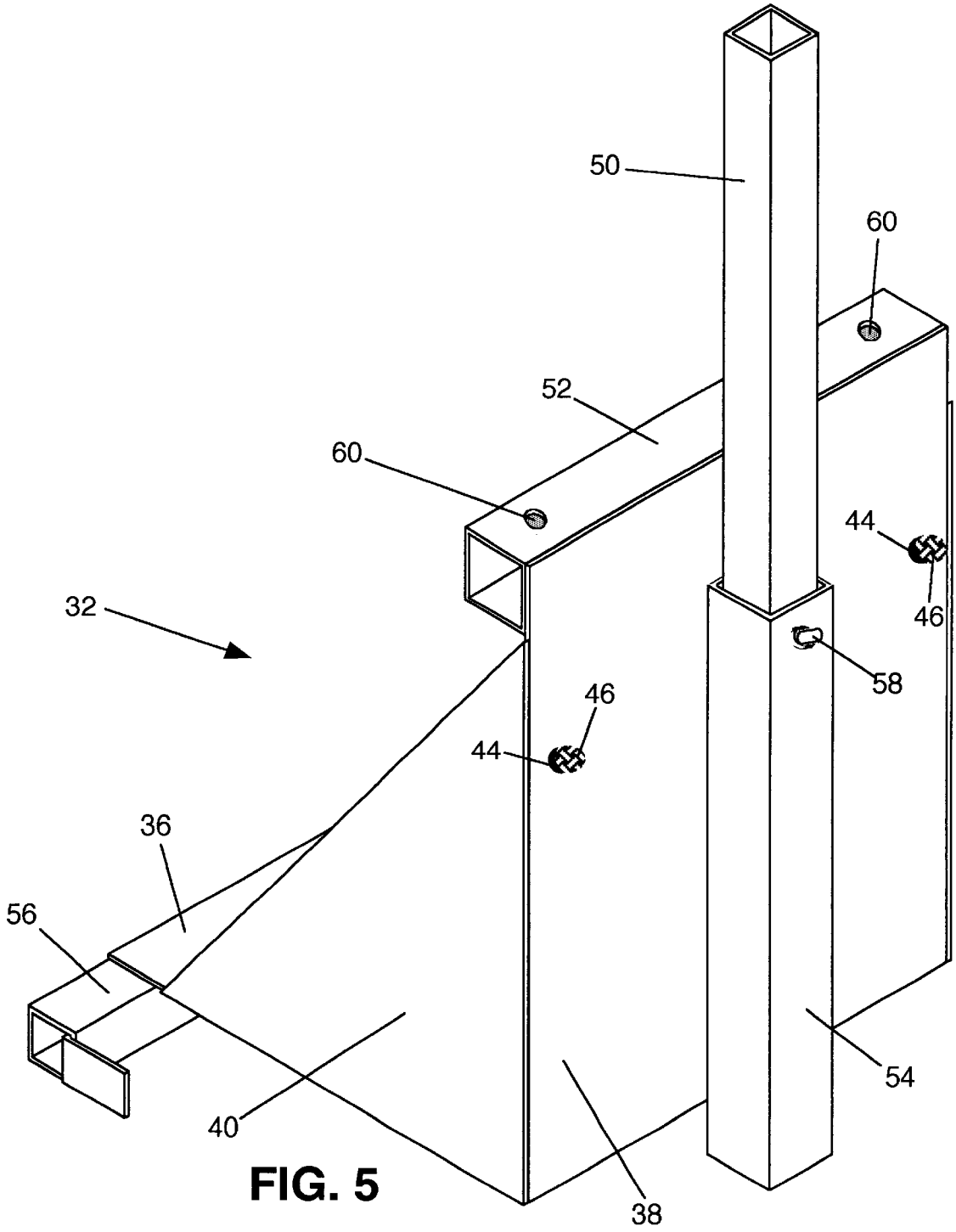
FIG. 5 is a perspective view of the assembled paint bucket holder showing a configuration in which the rung attachment arm has been stowed in a vertical position.
Figure 6:
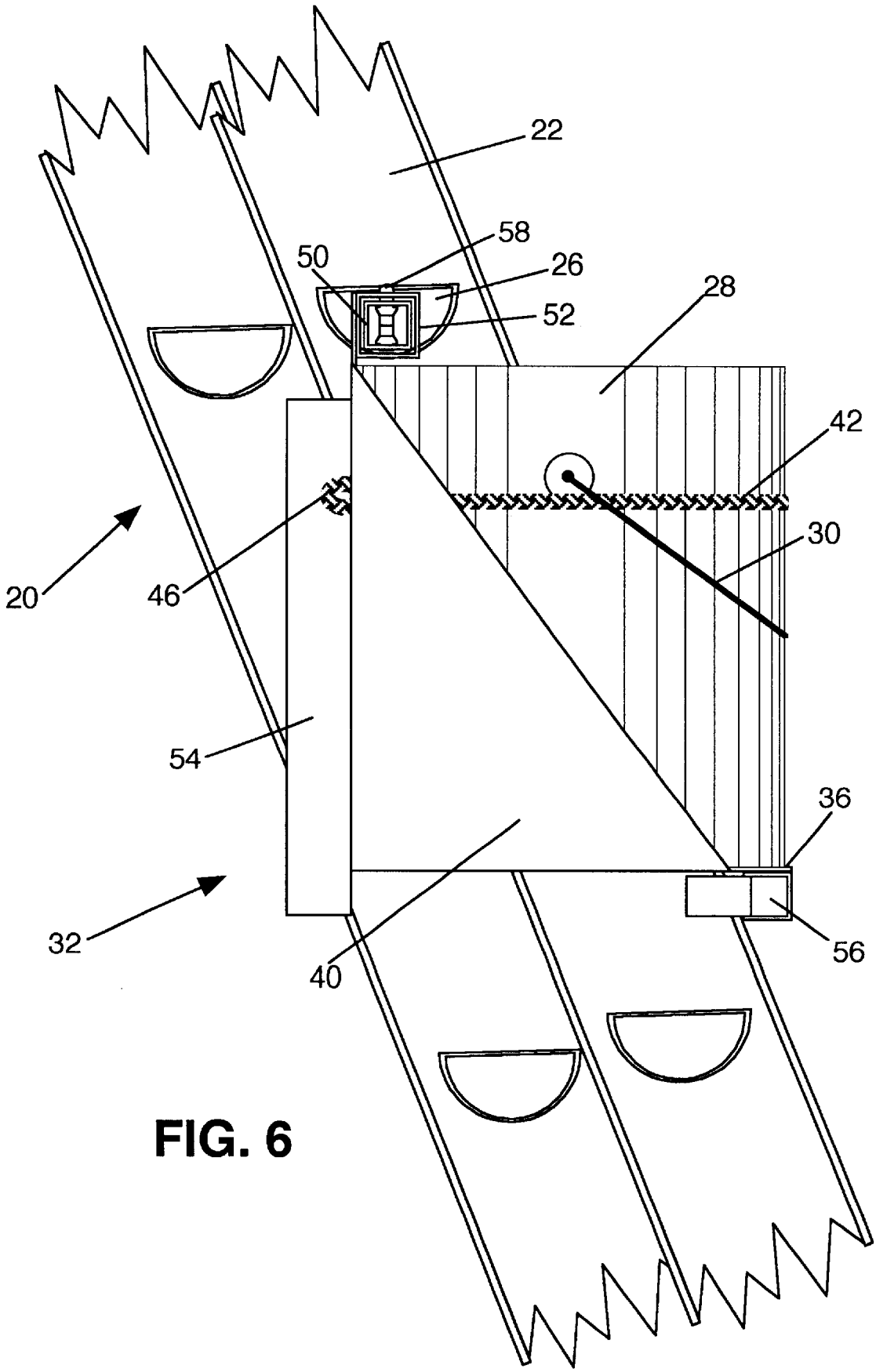
FIG. 6 is a side elevation view of the paint bucket holder, containing and supporting the paint bucket, illustrating attachment of the paint bucket holder to a typical, inclined, hollow rung ladder.
Figure 7:
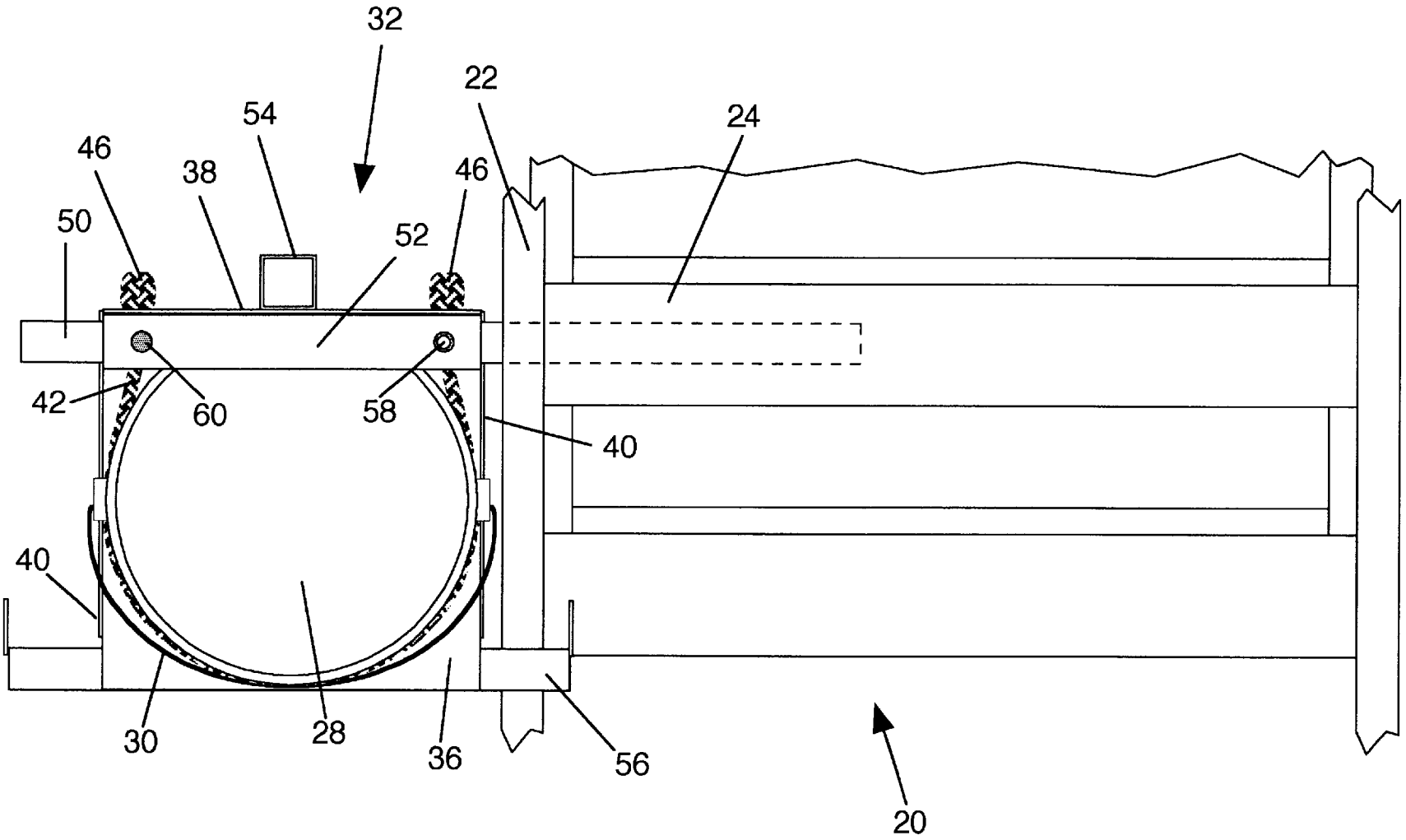
FIG. 7 is a top view of the paint bucket holder, containing and supporting the paint bucket, removably attached for use to the typical, inclined, hollow rung ladder, as in FIG. 6, further illustrating the method of attachment.

The primary elements of the preferred embodiment of the present invention are a paint bucket container 34, shown assembled in FIG. 1, and a ladder attachment apparatus 48, comprising the group of parts shown in FIG. 2. A fully assembled paint bucket holder 32 is shown in various configurations of a rung attachment arm 50 in FIG. 3, FIG. 4, and FIG. 5. A standard, one gallon paint bucket 28, having a paint bucket bail 30, is inserted and secured within paint bucket holder 32 which is removably attached to the left side of a commercially available, inclined, hollow rung ladder 20 as depicted by FIG. 6 and FIG. 7.

Figure 3:
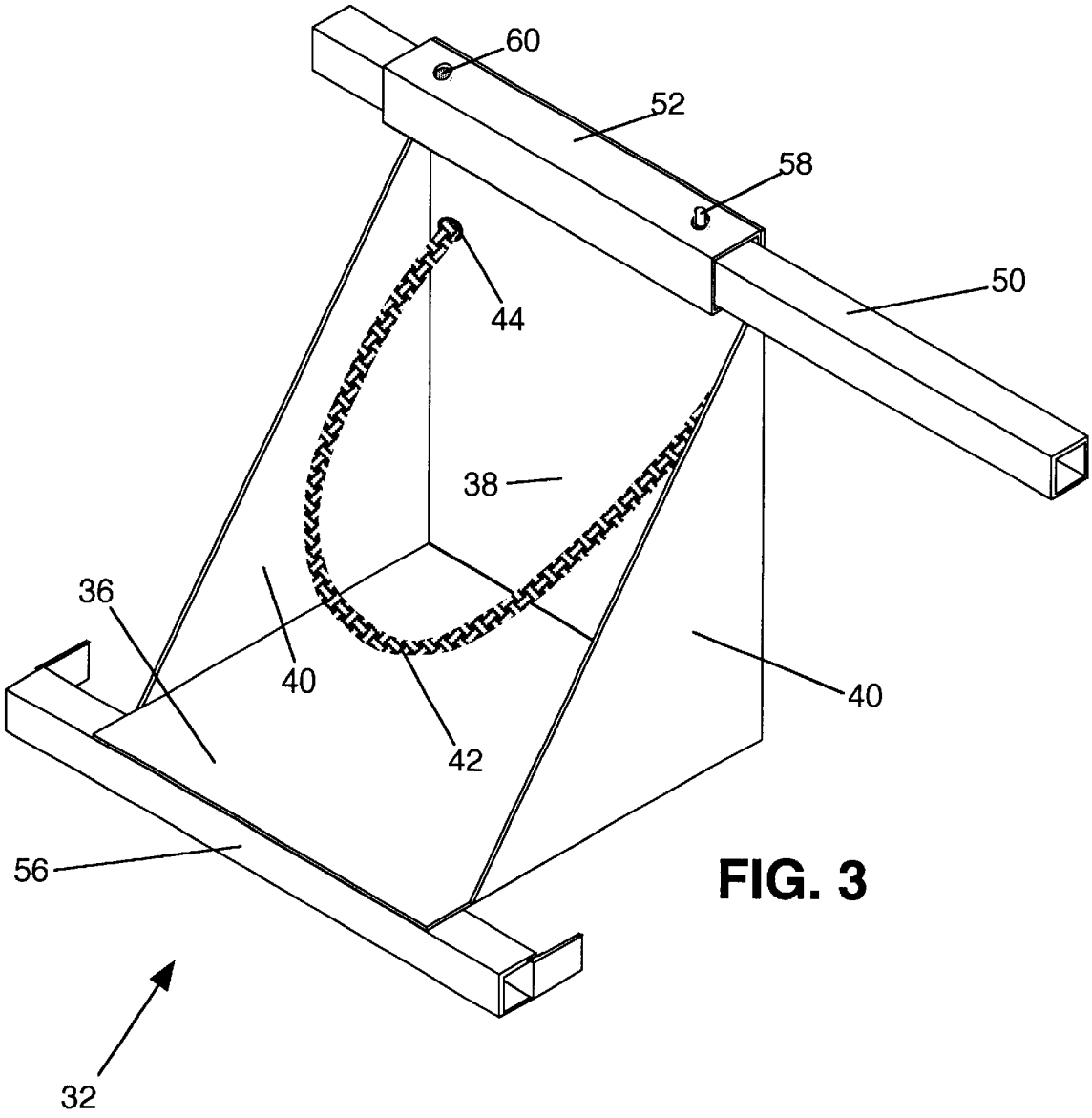
FIG. 3 is a perspective view of the assembled paint bucket holder, configured to be attached to the left side of a hollow rung ladder.

Referring to FIG. 1, paint bucket container 34 includes a container base 36, an upright panel 38, two triangular braces 40, and an elastic cincture 42. Container base 36 provides a horizontal seat to fully contact and support the bottom surface of paint bucket 28. The lower edge of upright panel 38 attaches to the back edge of container base 36 and forms a vertical surface to mate with and contain the upright cylindrical edge of paint bucket 28. Triangular braces 40 attach to the right and left edges of container base 36 and upright panel 38 to enhance the rigidity of the perpendicular alignment of these members. Elastic cincture 42 is inserted through two cincture apertures 44, near the vertical edges of upright panel 38, and is restrained from retracting through cincture apertures 44 by two cincture knots 46, as illustrated in FIG. 3.

Figure 4:
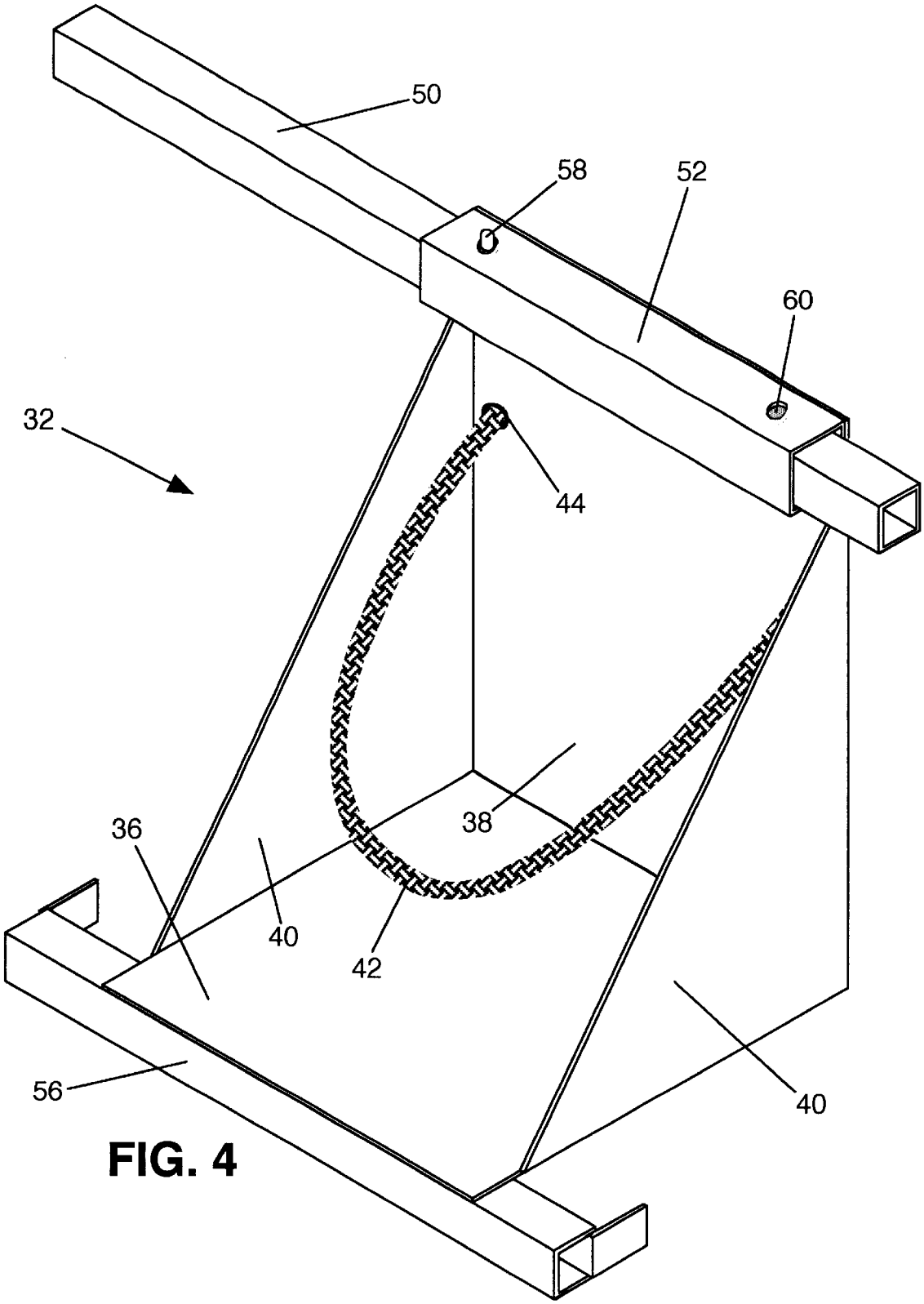
FIG. 4 is perspective view of the paint bucket holder of FIG. 3, showing a rung attachment arm extended on the opposite side of the paint bucket holder to facilitate attachment to the right side of the hollow rung ladder.

Referring to FIG. 2, ladder attachment apparatus 48 includes a rung attachment arm 50, an arm support sleeve 52, an arm holder 54, a stabilization projection 56, and an arm detent 58. Ladder attachment apparatus 48 assemblage of members, shown in FIG. 2, are integrated with paint bucket container 34, shown in FIG. 1, to produce paint bucket holder 32, shown in FIG. 3, FIG. 4, and FIG. 5. Arm support sleeve 52 is rigidly attached at the top of the front surface of upright panel 38, such that the underside surface is positioned slightly above the nominal location of the lip of paint bucket 28, positioned within paint bucket container 34. In FIG. 3, rung attachment arm 50 is inserted into, and secured within, the arm support sleeve 52 such that rung attachment arm 50 extends to the right side of paint bucket holder 32 for insertion into a hollow rung cavity 26 from the left side of the hollow rung ladder 20. Arm detent 58 is contained within, and at the center of, rung attachment arm 50 for engaging either of two arm detent orifices 60 located at both ends of the arm support sleeve 52. Rung attachment arm 50 may be positioned to extend to either side of paint bucket holder 32 by disengaging arm detent 58 and sliding rung attachment arm 50 within arm support sleeve 52. FIG. 4 shows paint bucket holder 32 with rung attachment arm 50 extended to the left of paint bucket holder 32 for insertion into hollow rung cavity 26 from the right side of hollow rung ladder 20. Stabilization projection 56 is rigidly attached to the underside, near the front edge, of container base 36, as shown in FIG. 3, extending from both sides of paint bucket container 34 to engage the upper edge of a ladder leg 22 and securely maintain a near horizontal orientation of container base 36. Referring to FIG. 5, arm holder 54 is attached vertically at the center of the back surface of upright panel 38, extending a distance, equivalent to the vertical thickness of stabilization projection 56, below the underside of container base 36, to position container base 36 horizontally when paint bucket holder 32 is residing on a flat horizontal surface. The lower end of arm holder 54 is closed and an arm detent orifice 60 is provided near the top of arm holder 54 such that rung attachment arm 50 may be inserted into arm holder 54 and stowed securely upright when paint bucket holder 32 is not in use.

Referring to FIG. 1, the preferred material for the flat, rigid, container base 36, upright panel 38, and triangular braces 40 of paint bucket container 34 is 22 gauge sheet metal. Sheet metal is readily available from multiple commercial sources, is a good compromise between rigidity and weight, and can be easily bent such that container base 36 and upright panel 38 or container base 36, upright panel 38, and both triangular braces 40 can be constructed from a single contiguous sheet. This material selection is only illustrative for the preferred embodiment of the present invention as other materials, such as wood or molded plastic or fiberglass could also be used. A combination of wood, plastic, or fiberglass for some elements and metal for the other elements is also a credible consideration. Commercially available bungee cord is preferred for elastic cincture 42 although other suitable elastic materials could be used. Dimensions for these elements are primarily chosen to be consistent with the size and shape of paint bucket 28. Although there are some slight variations, a standard, one gallon, commercially available, paint bucket 28 is nominally 7¾ inches tall and 6⅝ inches in diameter. Paint bucket container 34 should provide for a space slightly larger than paint bucket 28.

Referring to FIG. 2, the preferred material for rigid elements, rung attachment arm 50, arm support sleeve 52, arm holder 54, and stability projection 56 of ladder attachment apparatus 48 is thin walled, square, aluminum tubing. This type of aluminum tubing is commercially available from multiple sources and is light weight and sufficiently rigid and strong consistent with attachment of paint bucket holder 32, containing paint bucket 28, to hollow rung ladder 20. Rectangular cross section tubing is preferred to cylindrical cross section tubing because it provides the capability to mate two flat surfaces for ease of attachment to paint bucket container 34. It should be noted, however, that other materials, such as wood, plastic, or fiberglass could be used and configured into cylindrical or rectangular, including square, cross section for these elements. Arm support sleeve 52 and arm holder 54 must be hollow to accommodate rung attachment arm 50, but rung attachment arm 50 and stabilization projection 56 could be solid subject to weight versus cost and arm detent 58 configuration considerations. Dimensions of these elements are determined by the characteristics of hollow rung ladder 20 and the total weight of paint bucket holder 32, containing an essentially full paint bucket 28. Inside dimensions for hollow rung cavity 26 typically vary from 15/16 to 1⅛ inches. The outside dimension of rung attachment arm 50 cross section must be slightly smaller than hollow rung cavity 26 inside dimension and also be as large as possible to minimize sag of rung attachment arm 50, relative to the horizontal orientation of ladder hollow rung 24, while supporting paint bucket holder 32. It is noted that rung attachment arm 50 cross section outside dimension could be chosen to mate with a specific hollow rung cavity 26, thus avoiding the necessity to interface with the full range of hollow rung cavity 26 inside dimensions.

As illustrated in FIG. 5, arm support sleeve 52 is rigidly attached to the front surface of upright panel 38, leaving the back surface unobstructed to facilitate insertion of rung attachment arm 50 into arm holder 54. Referring to FIG. 7, the length of arm support sleeve 52 is essentially the width of upright panel 38, allowing for sufficient length to provide adequate leverage for supporting and maintaining essentially full, paint bucket 28 substantially upright while avoiding interference with ladder leg 22. An arm orifice is located near each end of arm support sleeve 52, providing for passage of the butterfly clip tip through the upper surface, so as to be easily reached by the thumb of the same hand gripping rung attachment arm 50 outside of paint bucket holder 32. Referring to FIG. 2, the diameter of arm orifice 60 is somewhat larger than the width of arm detent 58 tip to allow the user to readily depress arm detent 58 tip below the inner surface of arm support sleeve 52. Typical diameters for arm detent 58 butterfly clip tip, rung attachment arm 50 detent engagement holes, and detent orifice 60 are 3/16 inch, ¼ inch, and ⅜ inch, respectively.

As indicated by FIG. 5, arm holder 54 is dimensioned to allow rung attachment arm 50 to be easily inserted and secured. Arm holder 54 inside dimension is slightly larger than rung attachment arm 50 outside dimension to allow adequate clearance for easy insertion of rung attachment arm 50. The length of arm holder 54 is as short as possible consistent with providing for location of detent orifice 60 near the top of the rear surface of arm holder 54 to align with arm detent 58 when rung attachment arm 50 is inserted into arm holder 54.

As illustrated in FIG. 3 and FIG. 4, stabilization projection 56 is rigidly attached to the underside, and near the front edge of container base 36. This positioning is selected to provide a substantially upright disposition of paint bucket 28 when paint bucket holder 32 is attached to hollow rung ladder 20, inclined at 15 to 30 degrees from vertical, as shown in FIGS. 6 and 7. Stabilization projection 56 extends outward from container base 36 on both sides by 2 to 3 inches to engage ladder leg 22. A perpendicular bend, of ½ to ¾ inches at each end of stabilization projection 56 overlaps ladder leg 22 to negate inadvertent disengagement from ladder leg 22.

The preferred embodiment of the present invention implements a commercially available plastic butterfly clip for arm detent 58, as shown in FIG. 2. This clip is presently used in many applications to secure an extendible, cylindrical, thin wall pole within a slightly larger diameter, thin wall sleeve. The plastic material used for the butterfly clip has sufficient elasticity to allow full compression of the clip with minimal pressure and the springable resilience to return the clip to its original shape when pressure is released. The clip must be compatible with being inserted inside rung attachment arm 50. The clip engages two holes in rung attachment arm 50 with the two tips located at the clip extremities. As illustrated in FIG. 6, one of the two tips has been shortened so that, when inserted into the hole, it is flush with the outside surface of rung attachment arm 50. The other butterfly clip tip extends through the hole in the opposite surface of rung attachment arm 50 to engage arm orifice 60 and protrude, above the upper surface of arm support sleeve 52, and to the rear of the back surface of arm holder 54, as shown in FIG. 5.

Operation—Preferred Embodiment

FIG. 6 and FIG. 7 illustrate the intended attachment of paint bucket holder 32 to the left side of commercially available, inclined, hollow rung ladder 20. FIG. 6 shows paint bucket holder 32, containing paint bucket 28, removably attached to hollow rung ladder 20. Hollow rung ladder 20 is depicted as an extension ladder in this case. FIG. 6 is an elevation view showing the end view of rung attachment arm 50, inserted into hollow rung cavity 26, contained within arm support sleeve 52, and secured at the extended position to the right side of paint bucket holder 32 by arm detent 58. The right side extension of stabilization projection 56 is resting on the upper edge of left ladder leg 22. FIG. 7 is a top view clearly showing rung attachment arm 50 extending into ladder hollow rung 24 and the right extension of stabilization projection 56 engaging the upper edge of left ladder leg 22, securely supporting paint bucket 28 to within a few degrees of upright orientation. Extension ladders are typically inclined by the user, for safety reasons, to between 15 and 30 degrees from vertical (the inclination of ladder 20 shown in FIG. 6, and FIG. 7, is 22 degrees from vertical). Stabilization projection 56 is further inhibited from slipping from ladder leg 22 by the perpendicular bend at each end of stabilization projection 56. FIG. 6 also illustrates that very little of paint bucket holder 32 extends below ladder 20 profile, minimizing the risk of contact or interference with the structure supporting the upper end of hollow rung ladder 20.

In order to attach paint bucket holder 32, containing paint bucket 28, to hollow rung ladder 20 as shown in FIG. 6 and FIG. 7, a nominal size, one gallon paint bucket 28, having paint bucket bail 30, is first inserted into paint bucket holder 32 shown in FIG. 3. The user grips, lifts, and stretches elastic cincture 42 away from container base 36 and upright panel 38 and inserts paint bucket 28 into paint bucket holder 32 such that the bottom surface of paint bucket 28 rests securely and firmly on container base 36 and the cylindrical vertical side contacts upright panel 38. Elastic cincture 42 is then released to encircle the cylindrical circumference of paint bucket 28, in essentially a horizontal plane, such that paint bucket 28 is securely contained within paint bucket holder 32, with paint bucket 28 lip positioned beneath arm support sleeve 52 and with paint bucket bail 30 free to be rotated vertically to provide for lifting paint bucket 28 and paint bucket holder 32 as a unit. Paint bucket holder 32, containing paint bucket 28, is transported to the desired position on hollow rung ladder 20 by gripping, lifting, and carrying the unit with one hand using vertically extended paint bucket bail 30. Paint bucket holder 32 is attached to hollow rung ladder 20, with one hand gripping paint bucket bail 30, by inserting rung attachment arm 50 into the selected hollow rung cavity 26 as far as practical, so that paint bucket container 34 closely abuts the left ladder leg 22, and engaging the upper edge of ladder leg 22 with stabilization projection 56.

Referring to FIG. 6 and FIG. 7, paint bucket holder 32, containing paint bucket 28, is easily relocated on the same side of hollow rung ladder 20 with one hand. User grips and rotates paint bucket bail 30 past vertical orientation, contacts arm support sleeve 52, and exerts pressure against arm support sleeve 52 so as to rotate paint bucket holder 32 about rung attachment arm 50 sufficiently to allow for disengagement of stabilization projection 56 from ladder leg 22. With paint bucket holder 32 so disposed, user extracts rung attachment arm 50 from ladder hollow rung cavity 26. User then moves paint bucket holder 32 up or down, while gripping paint bucket bail 30 with one hand, and inserts rung attachment arm 50 into selected hollow rung cavity 26. Paint bucket holder is rotated slightly by user, as previously described, to allow engagement of ladder leg 22 with stabilization projection 56, and rung attachment arm 50 is inserted into hollow rung cavity 26 such that paint bucket container 34 closely abuts left ladder leg 22. User rotates and releases paint bucket bail 30 so that paint bucket holder 32 is securely attached to hollow rung ladder 20 with paint bucket 28 disposed nearly upright and paint bucket bail 30 positioned so as to not interfere with user painting activities.

Figure 8:
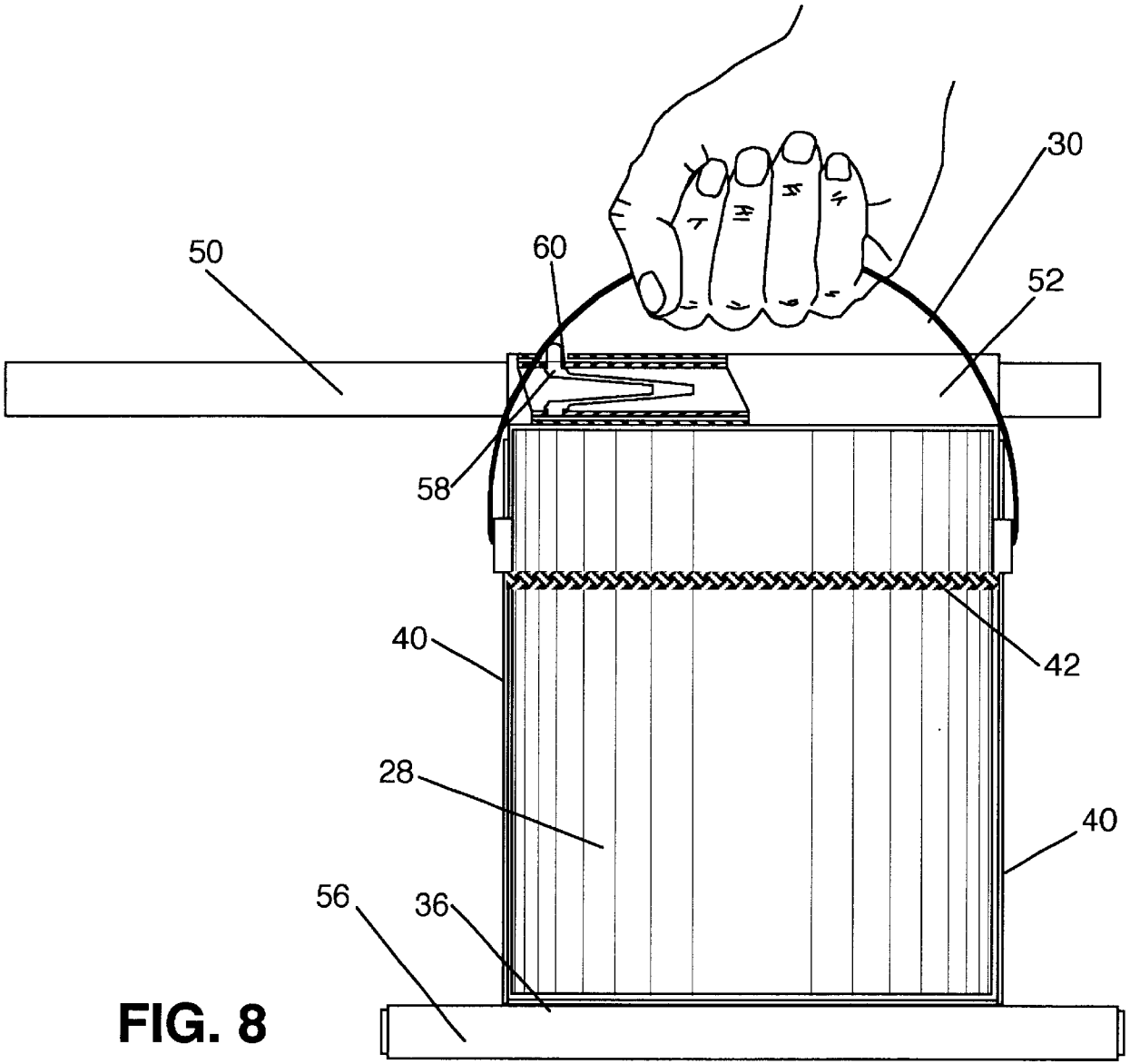
Figure 9:
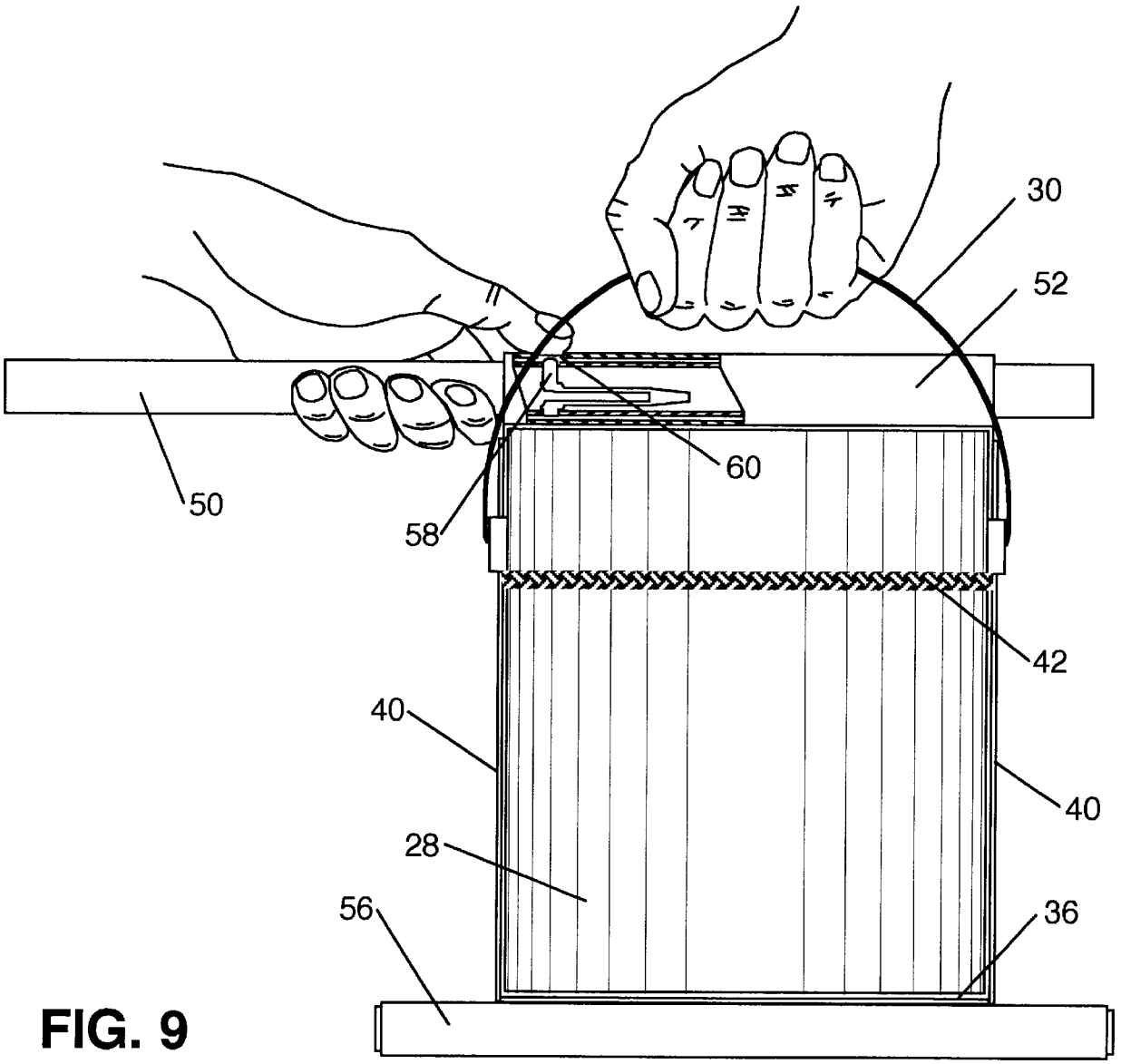
Figure 10:
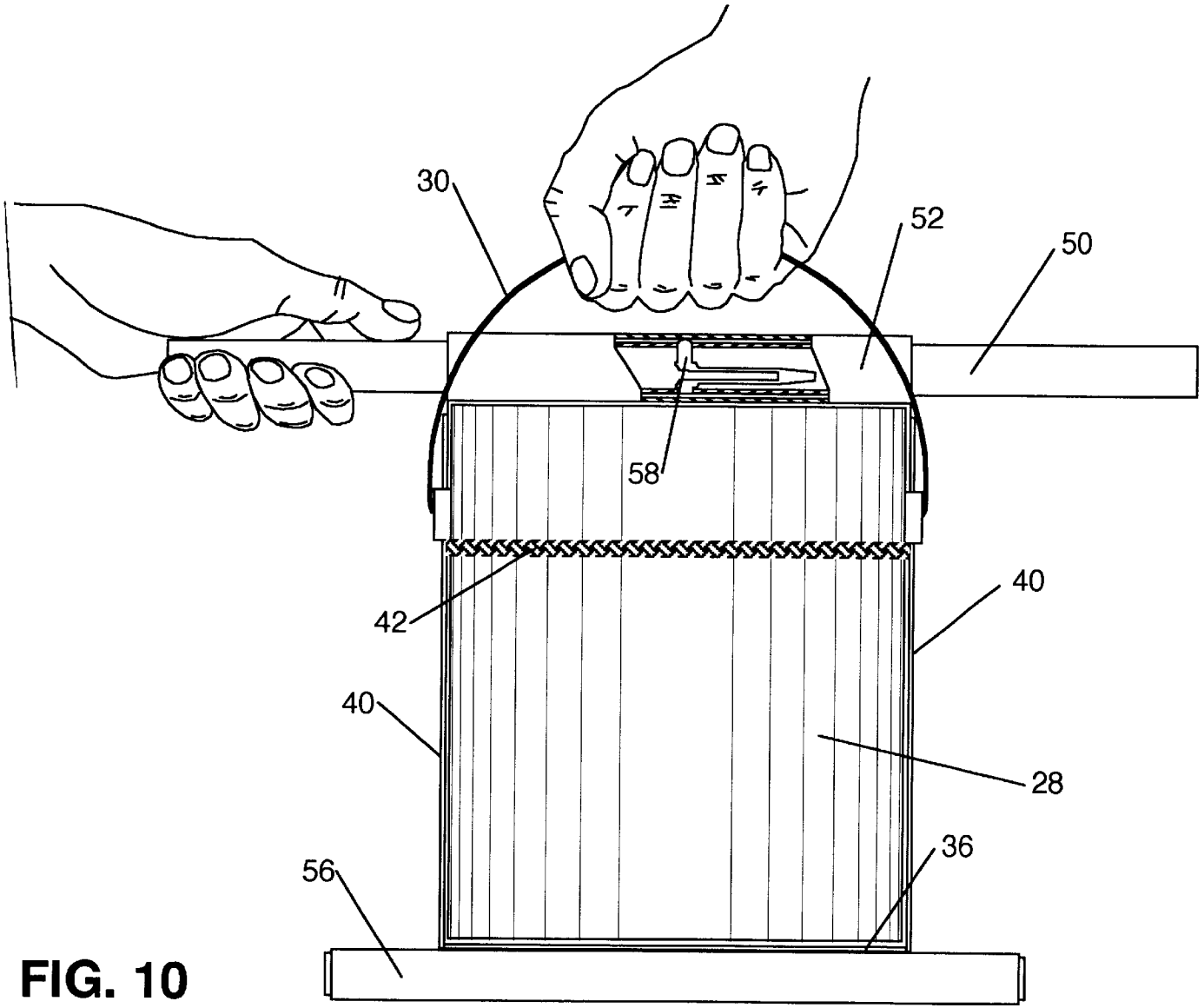
Figure 11:
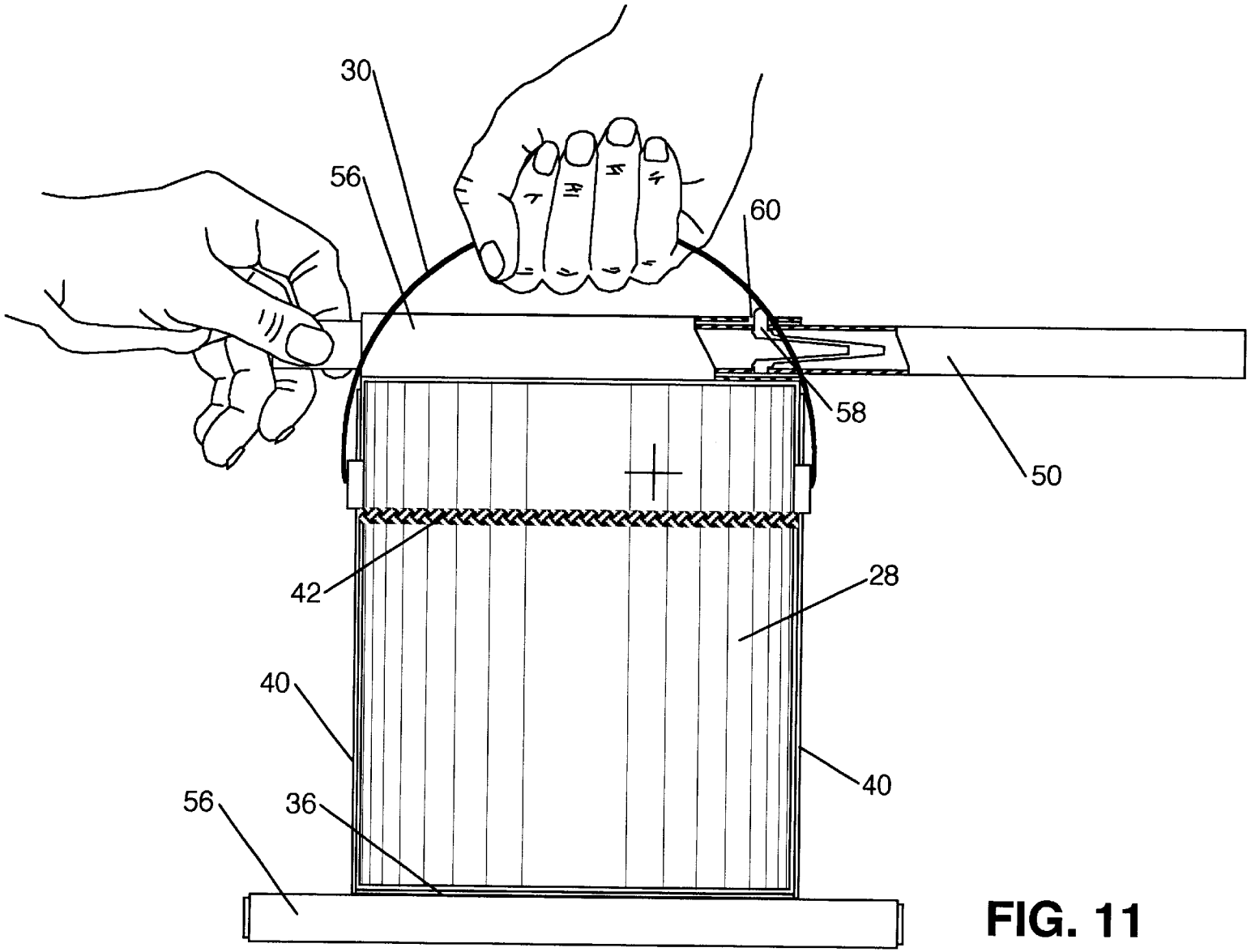

Paint bucket holder 32, containing paint bucket 28, is easily removed from one side of hollow rung ladder 20 and attached to the opposite side. User first grips vertically disposed paint bucket bail 30 and extracts rung attachment arm 50 from hollow rung cavity 26 with one hand as described in the preceding paragraph. FIG. 8 through FIG. 11 are front views of paint bucket holder 32, containing paint bucket 28, which show the exterior of rung attachment arm 50 and arm support sleeve 52 in cross section to illustrate the process of reversal of the direction of rung attachment arm 50 by the user's other hand. Referring to FIG. 8, user holds paint bucket holder 32, containing paint bucket 28, upright with one hand gripping the vertically disposed paint bucket bail 30. FIG. 9 shows the user disengaging arm detent 58, with the thumb of the other hand, by depressing arm detent 58 through arm detent orifice 60 such that arm detent 58 is wholly contained within arm support sleeve 52. FIG. 10 shows the user sliding rung attachment arm 50 within arm support sleeve 52 to extend on the opposite side of paint bucket holder 32. In FIG. 11 arm detent 58 engages arm detent orifice 60 on the opposite end of arm support sleeve 52, securing rung attachment arm 50 fully extended on the opposite side of paint bucket holder 32. The user now shifts the grip on paint bucket bail 30 to the other hand and follows the process described in the preceding paragraph to attach paint bucket holder 32 to the opposite side of hollow rung ladder 20.

FIG. 5 is a perspective view of paint bucket holder 32 with rung attachment arm 50 stowed in arm holder 54 to facilitate convenient, unobstructed transport of paint bucket holder 32. To achieve this configuration the user disengages paint bucket holder 32 from hollow rung ladder 20 with one hand, as previously described. While continuing to grip paint bucket bail 30 with one hand, user disengages arm detent 58 with the other hand, as illustrated in FIG. 9, and extracts rung attachment arm 50 from arm support sleeve 52. User then rotates rung attachment arm 50 to a vertical disposition and inserts rung attachment arm 50 such that arm detent 58 engages arm detent orifice 60 in arm holder 54, securing rung attachment arm 50 in an upright position. User may store paint bucket holder 32 in this configuration in minimal space.

Alternative Embodiments

There are various possibilities for the configuration of the arm detent in the present invention. FIG. 12A is a perspective view of the paint bucket holder with a linch pin substituted for the plastic butterfly clip. For this alternative the linch pin is inserted entirely through the arm attachment arm and the arm support sleeve or arm holder to secure the rung attachment arm. Two holes are provided for each arm detent orifice, located on opposite sides of the arm supporting members. Referring to FIG. 5, the orientation of the arm detent is rotated such that these two holes are located on both sides of the arm holder, allowing the linch pin to be inserted parallel to the back surface of the upright panel. The linch pin is attached to the arm support sleeve by a chain to negate the possibility of the user accidentally dropping the pin while working on the ladder. This chain is long enough to allow the pin to be easily inserted into the holes in either the sleeve or the holder. A full scale perspective drawing of the linch pin, including the securing chain, is provided in FIG. 12B. The operation of the invention is unchanged for this arm detent alternative except that depressing the butterfly clip is replaced by extracting the linch pin. The linch pin is reinserted into the detent orifice at the selected end of the arm support sleeve to extend the rung attachment arm in the desired direction. This alternative is compatible with either a hollow or solid configuration of the rung attachment arm.

FIG. 12C is a full scale perspective drawing of a hitch pin alternative for the arm detent. The hitch pin is a variation of the linch pin, providing the additional capability to remain seated in the detent orifice if the ring on the pin is inadvertently pulled by the user. The hitch pin has a retractable ball bearing imbedded in the lower end which can be forced through the detent orifice and will negate the upward motion of the pin due to an inadvertent extraction attempt. However, the hitch pin is more difficult to insert and extract than the linch pin. As with the linch pin, the hitch pin should be secured by a chain, or other suitable device, to the arm support sleeve.

The butterfly clip is selected as the preferred alternative for the arm detent. The butterfly clip is an integral part of the rung attachment arm, not requiring a chain or other security device to guard against accidental separation from the paint bucket holder, and is easier to manipulate than either the linch pin or the hitch pin.

Advantages

The following advantages of the present invention are evident:

a) The user can very quickly configure the paint bucket holder and mount a paint bucket.

b) The user can transport the paint bucket and holder unit to the desired position on the extension ladder with one hand.

c) The user can begin work immediately upon simply attaching the paint bucket holder to the ladder at the selected hollow rung.

d) As the work progresses the user can very easily and quickly reposition the paint on either side of the ladder, for convenience, without climbing off the ladder.

e) At the end of the job the user can, very simply, stow the rung attachment arm to minimize the paint bucket holder profile.

f) User will have no security or safety concerns about paint spillage or injury occurring.

g) The paint bucket holder is readily and economically manufacturable in quantities.

CONCLUSION, RAMIFICATIONS, AND SCOPE

The present invention is an innovative, fresh approach to advance the art of attaching a paint bucket to hollow rung ladders. The emphasis of the invention is primarily directed toward addressing the key issues presented by security and safety. Prior art in this field has placed emphasis on paint can leveling, reduction of moving parts, and simplicity of use. The present invention does not ignore these important aspects. The preferred embodiment maintains the paint bucket level within acceptable limits based on typical and safe use of an extension ladder for painting a structure. Moving parts have been reduced to the rung attachment arm which is positionable within a structure. Moving parts have been reduced to the rung attachment arm which is positionable within the arm support sleeve to provide a convenient and easy way to switch the paint bucket from one side of the ladder to the other. The paint bucket holder of the present invention is self contained, easy to use, and is readily manufacturable to produce economical units in quantity. A commercially available paint bucket holder is currently lacking, and this invention promises to fill that void.

Although the description of the present invention contains many specifics of the preferred embodiment, these should not be construed as limiting the scope of the invention. The embodiment described herein is subject to variations in structure, design, and manufacturing methodology. For example, practical, viable alternatives are presented herein for the arm detent. Dimensions provided for the elements and parts of the preferred embodiment of the invention are for exemplary purposes only, variations are conceivable within the scope of the invention. Methodology of manufacturing may vary, incorporating modular techniques for various combinations of parts. It may be practical and economical to use a combination of materials, such as wood, metal, plastic, and fiberglass, in the fabrication process. Accordingly, the scope of the invention should be determined by the appended claims their legal equivalents, and not be limited to the details disclosed herein.

Sequence Listing

Not applicable

I claim:

1. A paint bucket holder, removably attachable to a selected side of a ladder having hollow rungs and a pair of side support legs, interiors of said rungs being accessible through openings in said legs, said holder comprising:

(a) a generally rectangular base plate providing a flat, generally horizontal surface for supporting a paint bucket;

(b) a generally rectangular upright panel having a bottom edge connected at a substantially right angle to a rear edge of said base plate and having a top edge at a location above a top of said paint bucket;

(c) a rigid arm having a first end portion insertable in, and engageable with, a hollow rung and a second portion extending outward linearly away from said ladder;

(d) a sleeve adapted for slidably receiving said second portion of said arm, said sleeve being rigidly connected to an inside top edge portion of said panel;

(e) restraint means for releasably maintaining said arm and said sleeve in fixed linear relation to one another; and (f) means for securing said base plate in predetermined relation to an adjacent side support leg.

2. The paint bucket holder as defined in claim 1 wherein said means for securing said base plate comprises, at least one forward corner thereof, an outwardly projecting member connected to said plate and parallel to said sleeve, a rearwardly extending tab connected to said member so as to define an open space for receiving therein an upper edge of said side support leg, said tab engaging said upper edge and thereby preventing motion of said base plate away from said leg.

3. The paint bucket holder as defined in claim 2 wherein said means for securing the base plate is provided at both forward corners of said plate, thereby enabling the holder to be secured when placed on either selected side of the ladder.

4. The paint bucket holder as defined in claim 3 wherein said means for securing said base plate comprises a metal rectangular tube connected to a forward edge region of said base plate underneath said base plate, the tube extending outward past side edges of said base plate for a distance greater than a top width of said side support leg, and a tab connected to each outer end of the tube, each of the tabs, end portions of the tube, and side portions of the base plate defining an open space adapted to fit around said support leg and to restrain movement of the holder with respect to the ladder.

5. The paint bucket holder as defined in claim 2 wherein said restraint means for releasably maintaining said arm and said sleeve in fixed linear relation comprises at least one pin adapted to be inserted through mating apertures in said arm and said sleeve.

6. The paint bucket holder as defined in claim 2 including a cincture secured to an upper portion of said upright panel and adapted to reach around said paint bucket and secure the bucket from movement.

7. The paint bucket holder as defined in claim 6 wherein said sleeve is located in a position such that a bucket may be placed with a lip thereof under said sleeve and aligned to come into contact therewith.

8. The paint bucket holder as defined in claim 2 including a vertically oriented receptacle secured to a back side of said upright panel and adapted to receive said arm for storage during movement of the holder.

9. The paint bucket holder as defined in claim 8 wherein said arm, said sleeve, said securing member, and said receptacle are all comprised of rectangular metal tubing of a selected size.

10. The paint bucket holder as defined in claim 2 wherein said restraint means for releasably maintaining said arm and said sleeve in fixed linear relation comprises at least one detent engageable with an aperture in said sleeve.

11. The paint bucket holder as defined in claim 10 wherein said detent comprises a butterfly clip.

12. The paint bucket holder as defined in claim 2 including bracing means further securing said base plate to said upright panel.

13. The paint bucket holder as defined in claim 12 wherein said base plate, upright panels, and triangular bracing panels are comprised of sheet metal.

14. The paint bucket holder as defined in claim 12 wherein said bracing means comprises a pair of generally triangular side panels.

15. A method of securely attaching a paint bucket to either side of a hollow rung ladder, minimizing contact with the structure supporting the ladder, comprising the following steps:

(a) providing a removable paint bucket holder, comprising:

a paint bucket container, comprising two adjacent, rectangular, nearly perpendicular, rigid, substantially flat surfaces of predetermined size, forming a container base, for supporting the bottom of said paint bucket, and an upright panel, engaging the vertically oriented cylindrical edge of the bucket, two triangular braces, each attached to an opposed edge, and at the intersection, of the base and the panel, and an elastic cincture of predetermined size and elasticity, attached to the panel at two opposed points near the approximately vertical edges of the panel for encircling the bucket cylindrical shape in substantially a horizontal plane; and a removable ladder attachment apparatus, comprising a rigid rung attachment arm, of predetermined shape and size, for insertion into a hollow rung cavity of the ladder, an arm support sleeve, rigidly attached to the face and near the top of said upright panel, primarily for containing and securing said rung attachment arm, an arm holder, rigidly mounted to, and substantially horizontally centered within, the backside of said upright panel, to facilitate approximately vertical stowage of the arm, an arm detent, for securing the arm within said arm support sleeve and said arm holder, and a stabilization projection, rigidly mounted to the underside of said container base, extending a predetermined distance on both sides of the container for engaging the upper edge of a ladder leg on either side of the ladder;

(b) inserting and securing said paint bucket into said paint bucket container such that the bottom of the bucket contacts the top surface of the base, the back edge of the bucket cylindrical portion contacts the panel, the lip of the bucket is contained beneath the said arm support sleeve, and said elastic cincture encircles and makes firm contact with the bucket cylindrical shape in a substantially horizontal plane, to secure the bucket within said paint bucket holder such that the bucket bail is free to be vertically disposed;

(c) lifting and transporting the bucket within the holder, with one hand, by gripping the bail, to the desired position on the ladder;

(d) positioning said rung attachment arm within the sleeve and providing adequate extension of the arm for engaging the selected side of the ladder, such that said arm detent is properly engaged, securing the arm within the sleeve; and (e) inserting the arm into a selected ladder hollow rung cavity, such that said paint bucket container is nearly contacting the vertically disposed edge of said ladder leg, and engaging the upper edge of the leg with said stabilization projection, supporting and securing said container base close to horizontal alignment.

16. The method of claim 15 wherein there is further included the step of:

moving said paint bucket holder, with one hand, from one position on the ladder to another on the same side, by gripping the vertically disposed bucket bail, extracting the arm from said hollow rung cavity, inserting the arm into the selected rung cavity, such that the bucket container is nearly contacting the vertically disposed edge of said ladder leg, and engaging the upper edge of the leg with said stabilization projection.

17. The method of claim 15 wherein it is desired to move the bucket from one side of the ladder to the other and wherein there is further included the steps of:

(a) gripping the vertically disposed bucket bail and extracting said rung attachment arm from said hollow rung cavity;

(b) holding the bucket bail, with one hand, while reversing the direction of the arm with the other hand by releasing said arm detent and sliding the arm within the sleeve, such that the detent engages an arm detent orifice at the other end of the sleeve, securely locking the arm within the sleeve and providing adequate extension of the arm on the opposite side of said paint bucket container; and (c) inserting the arm into the selected rung cavity on the ladder, such that the bucket container is nearly contacting the vertically disposed edge of said ladder leg, and engaging the upper edge of the leg with said stabilization projection, supporting said container base close to horizontal alignment.

18. The method of claim 15 wherein it is desired to stow said rung attachment arm to reduce the overall profile of the holder and wherein there is further included the steps of:

(a) gripping the vertically disposed bucket bail and extracting said rung attachment aim from the rung cavity; and (b) releasing said arm detent, extracting the arm from the sleeve, rotating the arm to a substantially vertical disposition, and inserting the arm into said arm holder, such that said arm detent engages said arm detent orifice within the holder, securing the arm within the holder.

19. A readily manufacturable, paint bucket holder which is easily, conveniently, securely, and removably attached to either side of a hollow rung ladder, securely disposed to minimize contact with the structure supporting the ladder, said paint bucket holder comprising:

(a) a paint bucket container providing a secure upright mounting position for the paint bucket, said paint bucket container comprising a container base and an upright panel, of predetermined size, supporting said paint bucket, essentially formed from a single, continuous, rectangular sheet of reasonably rigid, generally flat, stock material, by a substantially straight, essentially right angle bend formed near perpendicular to the longer dimension of the sheet, two triangular braces, of predetermined size, formed from similar, reasonably rigid, generally flat, stock material, each attached to an opposed edge, and located near the intersection, of the base and the panel, providing rigidity enhancement, and an elastic cincture of predetermined size and elasticity, attached to the panel at two opposed points near the approximately vertical edges of the panel and encircling the bucket cylindrical shape in substantially a horizontal plane, securing the bucket from movement relative to the panel; and (b) a ladder attachment apparatus, providing a convenient means for mounting said paint bucket container to either side of said hollow rung ladder, comprising a rigid rung attachment arm, to be inserted into a hollow rung cavity for supporting said paint bucket container, made from hollow stock material of sufficient rigidity to support the combined weight of bucket and holder with negligible sag, having cross sectional dimension adequate to nearly fill the hollow rung interior, to minimize deviation from horizontal orientation, while allowing sufficient clearance to facilitate case of insertion and extraction, an arm support sleeve, rigidly attached to the face and near the top of said upright panel, primarily enclosing said rung attachment arm, in a substantially horizontal disposition, engaging the bucket lip and restricting upward movement of the bucket relative to the base, made from hollow stock material of rigidity comparable to, and having inside cross section dimension slightly in excess of, the outside dimension of said rung attachment arm, an arm holder, rigidly mounted to, and substantially horizontally centered within, the backside of said upright panel, to facilitate approximately vertical stowage of the arm, made from hollow stock material similar to that used for said arm support sleeve, with closed lower end and sides and open top to accommodate insertion of one end of the arm for stowage, an arm detent, securing the arm within the sleeve and the holder, easily released and engaged, and secured from inadvertent separation from said paint bucket holder, and a stabilization projection, rigidly mounted to the underside of said container base, extending a predetermined distance on both sides of the container for engaging the upper edge of the leg on either side of the ladder, providing stable alignment of said paint bucket container with the ladder incline.

* * * * *